US006189168B1

(12) United States Patent
Graebe

(10) Patent No.: US 6,189,168 B1
(45) Date of Patent: Feb. 20, 2001

(54) AIR CELL PILLOW

(76) Inventor: Kurtis F. Graebe, 29 Lakewood, Belleville, IL (US) 62223

( * ) Notice: Under 35 U.S.C. 154(b), the term of this patent shall be extended for 0 days.

(21) Appl. No.: 09/515,265

(22) Filed: Feb. 29, 2000

(51) Int. Cl.[7] ..... A47G 9/00

(52) U.S. Cl. ..... 5/644; 5/655.3; 5/645; 5/490

(58) Field of Search ..... 5/626, 640, 649, 5/645, 655.3, 490

(56) References Cited

U.S. PATENT DOCUMENTS

| | | | | |
|---|---|---|---|---|
| 2,434,641 | * | 1/1948 | Burns | 5/655.3 X |
| 3,064,279 | | 11/1962 | Finkle . | |
| 3,222,697 | | 12/1965 | Scheermesser . | |
| 3,251,075 | * | 5/1966 | Saltness et al. | 5/644 |
| 3,319,272 | | 5/1967 | Eller . | |
| 3,851,347 | | 12/1974 | Ashley . | |
| 3,924,283 | | 12/1975 | Shave . | |
| 4,147,825 | | 4/1979 | Talaly . | |
| 4,207,636 | | 6/1980 | Ceriani . | |
| 4,574,411 | | 3/1986 | Yagi . | |
| 4,726,087 | | 2/1988 | Schaefer et al. . | |
| 4,850,068 | | 7/1989 | Walpin et al. . | |
| 4,899,405 | | 2/1990 | Rothbard . | |
| 5,111,544 | * | 5/1992 | Graebe | 5/490 X |
| 5,121,515 | | 6/1992 | Hudson . | |
| 5,193,236 | | 3/1993 | Komuro . | |
| 5,210,894 | | 5/1993 | Minton . | |
| 5,388,296 | | 2/1995 | Mansour . | |
| 5,537,703 | | 7/1996 | Launder et al. . | |
| 5,596,781 | * | 1/1997 | Graebe | 5/655.3 |
| 5,689,845 | * | 11/1997 | Sobieralski | 5/655.3 X |
| 5,708,999 | * | 1/1998 | Priolo et al. | 5/644 |
| 5,729,851 | | 3/1998 | Hollander . | |
| 5,743,271 | | 4/1998 | Royo-Salvador . | |
| 6,047,425 | * | 4/2000 | Khazaal | 5/640 X |

* cited by examiner

*Primary Examiner*—Michael F. Trettel
(74) *Attorney, Agent, or Firm*—Howell & Haferkamp, LC

(57) ABSTRACT

An air cell pillow comprised of an air cushion with independent air cells extending outwardly from a common base sheet, the air cushion encased by a cover, the cover having a top, bottom and four side panels arranged generally in a box shape, the top and bottom panels each having a first thickness and the side panels each having a second thickness, the first thickness greater than the second thickness, the first thickness providing a smooth, continuous surface atop the independent air cells of the cushion and the second thickness allowing the pillow to readily collapse upon application of a load to the top and panel panels.

27 Claims, 5 Drawing Sheets

AIR CELL PILLOW

BACKGROUND OF THE INVENTION (1) Field of the Invention

The present invention relates to a type of pillow comprised of a cover and an air cell cushion. The cover is designed to collapse to produce a more comfortable pillow for the user.

(2) Description of the Related Art

Various attempts have been made over the years to create a pillow that provides the utmost comfort and therapeutic care for the user. These pillows have sought to reduce or correct neck and back discomfort for a person while they sleep. Many pillows in the art use a variety of contours, shapes, and materials to produce a comfortable positioning device for the person's head. These contouring devices are designed to distribute the load of a person's body while in the reposing position to reduce muscle strain and tension along the head, neck, and shoulders region of the body.

In the simplest design, the pillow is an easily deformable cushion, providing moderate support for the user's head and neck. Generally, the cushion is made from materials such as foam, polyethylene chips, goose down, horse hair, or some other easily deformable material. However, the common characteristics of these pillows is that the pillows may be too soft and too easily deformable for some users. Often the user has to "fluff up" their pillow to build up its relative resiliency. Unfortunately, during the course of a night, this resiliency is decreased, causing the pillow to lose its support. It is at this time that the user may experience undue stress on certain parts of the body, resulting in general discomfort, which may transmit throughout the body. Pillow cases of the prior art were designed to cover and protect the pillow and did not provide any shape or support function.

Newer designs of pillow construction have employed resilient underlying base materials that enable the pillow to generally maintain its shape under load. In the past, pillows of this category have used common foam materials formed with successive crossing layers of grooves and risers to create softness yet support for the pillow. More recent designs use foam materials with a system of contours in the cushion to supply support for the user. In these pillows, the contours are designed to limit the amount of deformation while supplying support as the person's head is cradled or supported in the pillow. Generally, these contours are formed in the natural shape of the person's head, neck, and shoulder regions for supine positions so that an even distribution of pressure is applied to these areas of the body so as to reduce undue strain and other stresses along the musculature of the spine. Often these contoured designs also utilize a convoluted surface to selectively control the resiliency in an area of the pillow. However, as a person moves during sleep, the person's body becomes misaligned with the preset contour of the pillow. This sometimes creates discomfort for the user. Additionally, the materials used as the base materials for these pillows must have sufficient structure to allow it to be formed in a contoured or convoluted shape. This structure is often not sufficiently breathable so as to permit the removal of moisture and heat from the person's body as they sleep. Thus, for this reason also, the pillow sometimes results in discomfort of the individual.

SUMMARY OF THE INVENTION

What is needed to overcome the disadvantages of prior art pillows is a pillow that is sufficiently firm to provide support, but yet is resilient enough to properly cradle and conform to a person's neck, head, and shoulders so as to prevent undue strain on these areas. Such a pillow would easily conform to the person's body as the person moves and positions themselves differently on the pillow. Moreover, such a pillow would be low cost, made from hypoallergenic materials, and have a firmness that is selectively adjustable for the individual's desired level of comfort.

In the past, it has been shown that an air mattress readily conforms to the shape of the part of the person's body which it supports. Air cells also provide a sufficient amount of resiliency that can be selectively controlled by air pressure inside the cell. The present invention combines the advantages of the air cells with a new cover to provide a maximum amount of support and comfort for the user.

In the preferred embodiment, the pillow is comprised of an air cushion contained in a padded cover. The air cushion is comprised of a plurality of air cells. The air cells are interconnected to permit air to flow between the cells. The air cells can be connected to a pump to inflate the air cells and a device to vary the pressure within the air cells. In the preferred embodiment, the air cushion is designed with two sections of air cells that extended outwardly and opposite each other to provide the maximum amount of contouring and comfort for the user regardless of which side of the air cushion is being used.

The cover for the pillow is generally shaped as a box having top and bottom panels with four peripheral sides extending between the top and bottom panels. The top panel of the cover may be padded to provide a smooth, continuous surface over the air cells. Alternately, both the top and bottom panels may be padded so that the pillow may be flipped over without a discernible difference in the level of comfort regardless of which side of the pillow is in use. The side panels of the cover are unpadded to allow the sides to readily collapse upon application of a load to the top and bottom panels and to reduce the amount of material that could bunch-up underneath the neck of a user when their head is resting on the pillow. Alternately, the cover may also be constructed of a stretchable fabric that tightly conforms to the air cushion. The use of stretchable fabric prevents the side panels of the cover from excessively bunching up underneath the neck of a user when a load is applied to the top and bottom panels. Preferably, the cover is made from a fabric that is sufficiently breathable and carries heat and moisture away from the body of the user. In the preferred embodiment of the cover, the cover has an access opening through a side panel through which the air cushion is inserted and removed. Additionally, the cover is provided with a button hole to allow an inflation device for the air cushion to be directed from within the cover to outside the cover. The cover may also have pockets to contain the inflation device and to provide the user with ready access to the inflation device.

BRIEF DESCRIPTION OF THE DRAWINGS

Further objectives and features of the invention are revealed in the following detailed description of the preferred embodiment of the invention and in the drawing figures wherein.

DETAILED DESCRIPTION OF THE INVENTION

Figure 1:
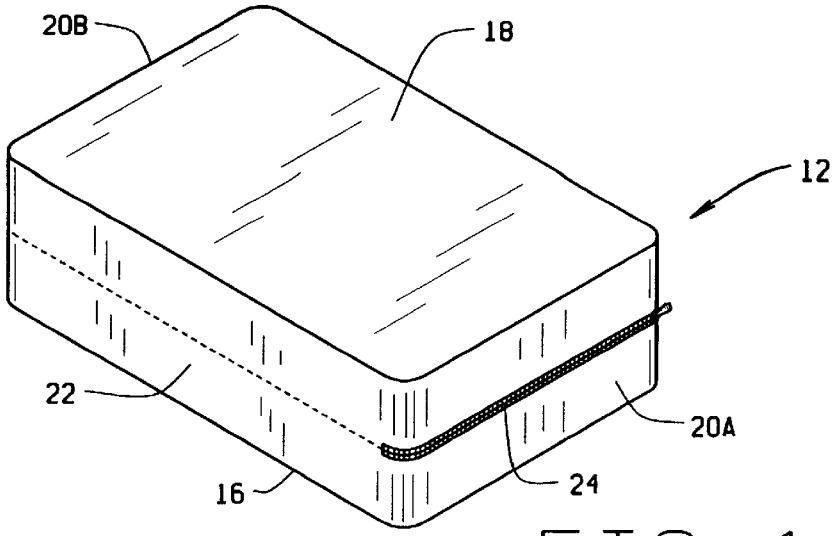
FIG. 1 is a perspective view of a cover for the pillow of the present invention with a zipper opening shown on one side panel.

The pillow of the present invention is generally indicated by reference numeral 10. The pillow 10 is comprised of a cover, generally indicated by reference numeral 12, and an air cushion, generally indicated by reference numeral 14.

Figure 2:
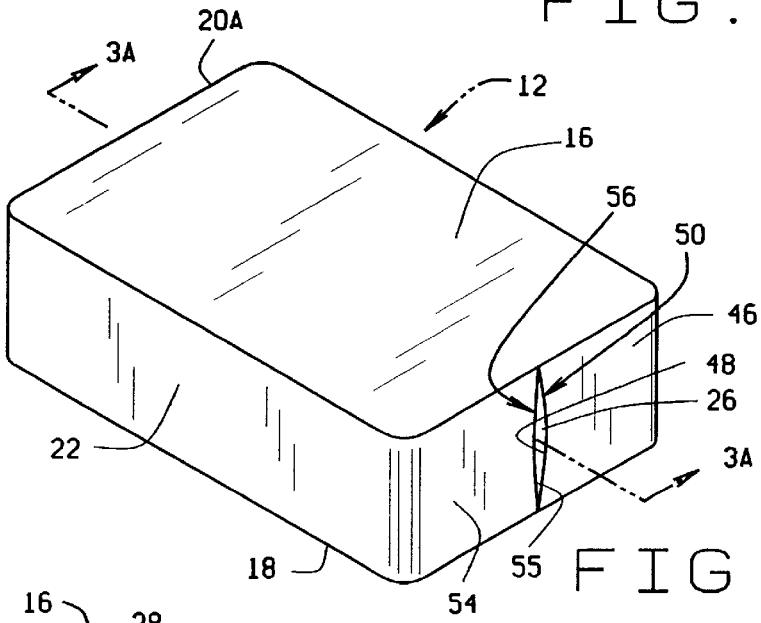
FIG. 2 is a perspective view of the cover of FIG. 1 turned over so as to show a slit opening on the opposite side panel from the zipper opening shown in the cover of FIG. 1.

FIGS. 1 and 2 show the general construction of the cover 12 of the present invention. The cover 12 consists of a top panel 16 and bottom panel 18 with two end panels 20A, 20B and two side panels 22 extending therebetween. Muslin or other light-weight and washable fabric may be used for the construction of the six panels. Each of the six panels has an outer perimeter edge that gives each panel a rectangular configuration. The outer perimeter edges of each of the end panels 20A, 20B and side panels 22, and the outer perimeter edges of each of the top panel 16 and bottom panel 18 are sewn together or secured together by other means to form a generally box-shaped cover.

Figure 3A:
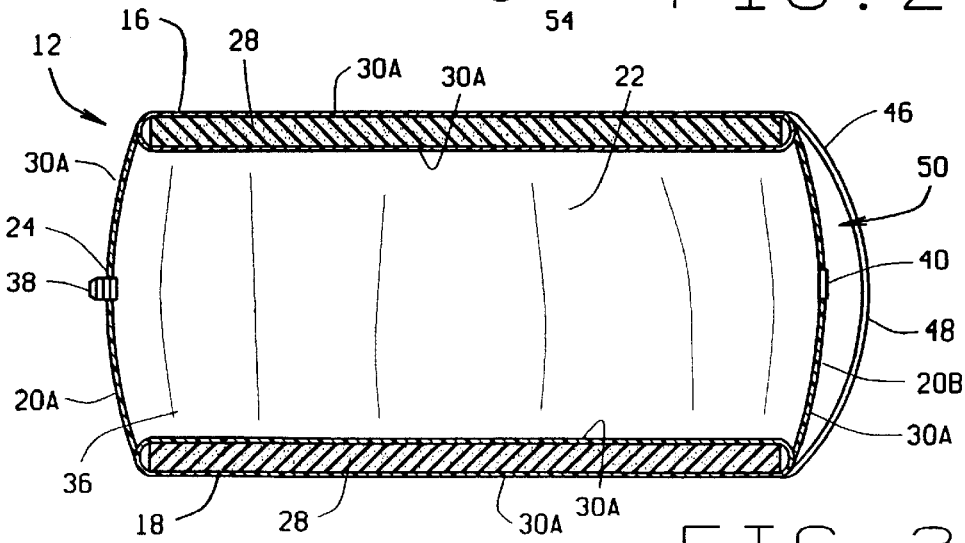
FIG. 3A is a cross-sectional view of the cover taken along the plane of lines 3A—3A of FIG. 2.
Figure 3B:
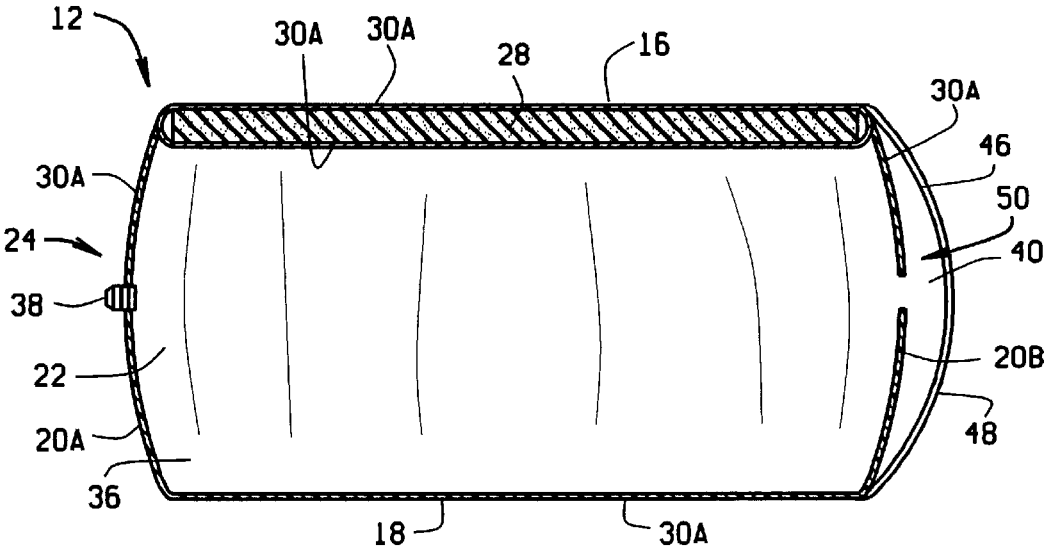
FIG. 3B is a cross-sectional view of an alternate embodiment of the cover of FIG. 3A.

In one embodiment of the cover 12, shown in FIG. 3A, the top panel 16 and bottom panel 18 each contain a layer of batting 28 or other equivalent type of padding. The layer of batting 28 is preferably contained between two layers of fabric 30A to protect the layer of batting 28 and contain the batting 28 within each of the top panel 16 and bottom panel 18. In an alternate embodiment of the cover 12, shown in FIG. 3B, only the top panel 16 contains the batting layer 28 and the bottom panel is formed without the batting layer. This gives the user the option to either use the padded top panel 16 or the unpadded bottom panel 18 for resting the head, neck and shoulders. In the embodiments of the covers shown in FIGS. 3A and 3B, the layer of batting 28 in each of the top panels 16 gives the top panel a first thickness. In the cover shown in 3A, the bottom panel 18 preferably contains a layer of batting 28 of the same thickness as the layer in the top panel 16, so that the user does not discern a difference in the padding when the pillow 10 is flipped over during use. Thus in this construction, the bottom panel 18 also has a first thickness.

Preferably, the batting 28 is a polyester fiber, non-hypoallergenic type filler material common in pillows and other clothing apparel. Cotton or other materials may also be used for the batting 28 without departing from the scope of the invention with the primary considerations being the material's ability to dissipate heat and moisture while providing comfort to the user.

Preferably, the end panels 20A, 20B and side panels 22 are each constructed with a single layer 30 of fabric of similar weight to that used in the top and bottom panels 16, 18 with no batting. More preferably, the end panels 20A, 20B and the side panels 22 are constructed from two layers of fabric arranged face-to-face such that the end panels 20A, 20B and the side panels 22 can be formed from the same layers of fabric used in the top and bottom panels 16, 18. Other methods of forming the end panels 20A, 20B and the side panels 22 may be used with different combinations of fabric layers without departing from the scope of the invention where the fabric layer or layers 30 used for the end panels 20A, 20B and the side panels 22 gives each of the end panels 20A, 20B and the side panels 22 a second thickness that is much smaller than the first thickness of the top panel 16 and the bottom panel 18. Constructing the end panels 20A, 20B and side panels 22 to form the second thickness, allows the pillow 10 to easily buckle or collapse upon application of a load to the top panel 16 or bottom panel 18 with little or no resistance from the end panels 20A, 20B and side panels 22. Providing the minimum amount of fabric material in the end panels 20A, 20B and side panels 22 prevents bunching up of fabric along the sides of the pillow when it is being used that could detract from the comfort of the user.

Figure 7A:
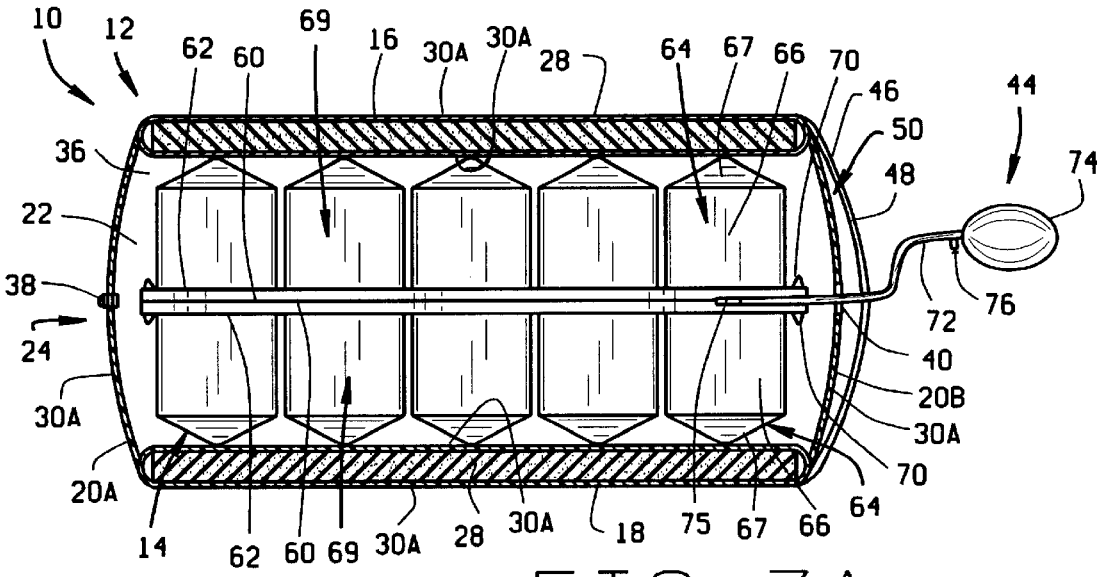
FIG. 7A is a cross-sectional view of the air cushion installed inside the cover taken along the plane of line 7A—7A in FIG. 6 with the inflation device extending from the button hole and the slit opening of the pocket.
Figure 7B:
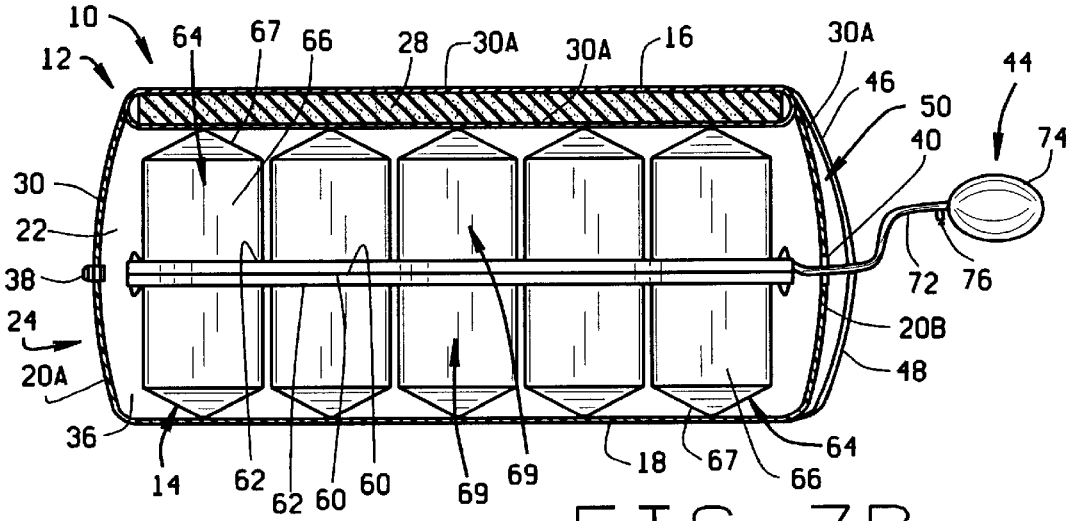
FIG. 7B is a cross sectional view of an alternate embodiment of FIG. 7A showing the cover of FIG. 3B and an alternate embodiment of the air cushion of FIG. 4.
Figure 7C:
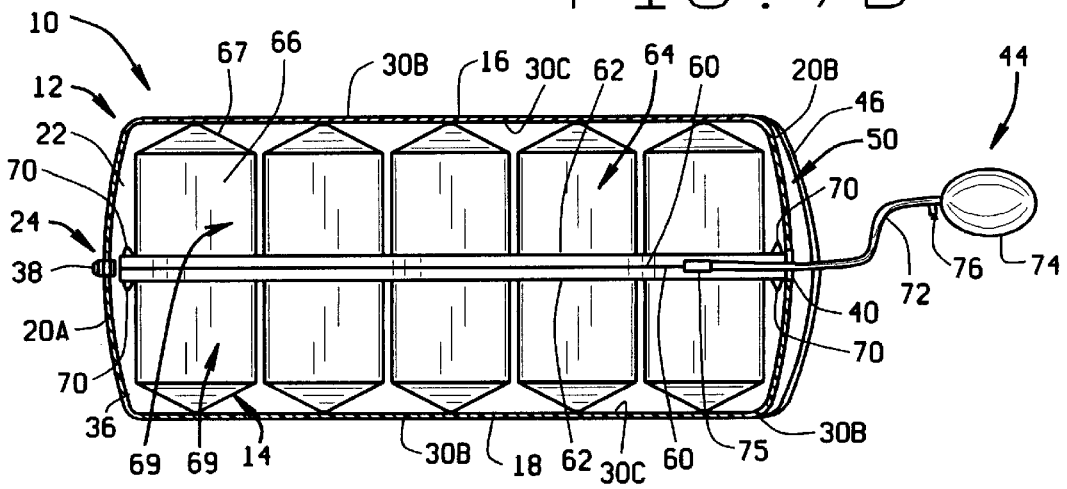
FIG. 7C is a cross sectional view of an alternate embodiment of FIG. 7A showing an alternate embodiment of the cover with the air cushion of FIG. 4 installed.

In another embodiment of the cover shown in FIG. 7C, the cover 12 is made from a stretchable fabric 30B. The fabric 30B may have a blended composition including cotton and spandex fibers to provide the required elasticity and comfort for the user. Because spandex fibers are not generally breathable, the cover 12 may also include a backing layer of fabric 30C in between the stretchable fabric and adjacent the air cushion to provide the maximum amount of breathability, moisture removal, and comfort for the user. Preferably, the stretchable fabric 30B allows the cover 12 to fit tightly around the air cushion 14 when the air cushion 14 is installed in the cover 12. Preferably, the cover 12 stretches tightly around the width of the air cushion 14 so that the fabric 30B for the cover 12 does not bunch up around the users head and neck region when the air cushion is collapsed under load. The cover 12 may have a looser fit around the length of the air cushion 14, since this area does not generally pose a problem of discomfort for the user. The cover 12 of the embodiment of FIG. 7C may be constructed with the batting layers arranged in the top panel 16 and bottom panel 18, in a similar manner to that shown in FIGS. 7A and 7B. The cover 12 shown in FIG. 7C does not use a batting layer in either panel, thus rendering the first thickness equivalent to the second thickness.

As best shown in FIGS. 1 and 2, the cover 12 preferably has an access opening 24 in one of the end panels 20A and a slit opening 26 in the opposite end panel 20B. The access 20 opening 24 provides access into the interior volume 36 of the cover 12 so that the air cushion 14 shown in FIG. 4 can be inserted into the interior volume 36. Preferably, the access opening 24 is aligned parallel to the planes of the top and bottom panels 16, 18 and centered between the top and bottom panels 16, 18. By centering the access opening 24 on the end panel 20A, the air cushion 14 can be more easily inserted into the interior volume 36 of the cover 12. The access opening 24 may be fitted with a closure mechanism, preferably a zipper 38, to secure the air cushion 14 within the interior volume 36 of the cover and to provide selective access into the interior volume 36 of the cover as desired by the user.

Figure 5:
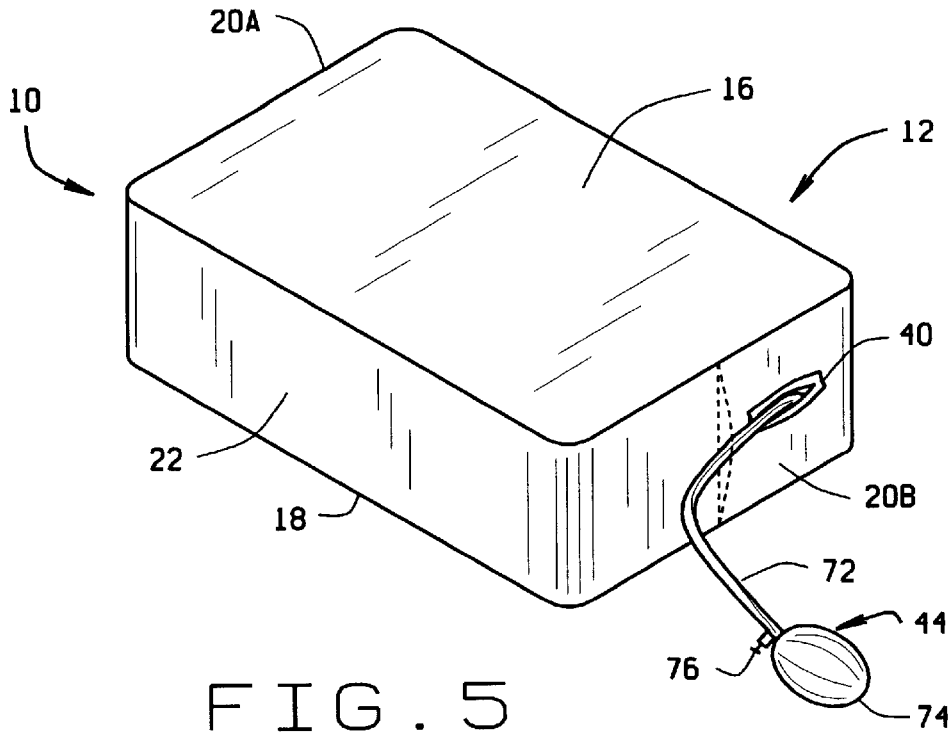
FIG. 5 is a perspective view of the pillow with the air cushion of FIG. 4 installed in the cover of FIG. 2 where a pocket or flap attached to a side panel is shown in dashed lines to show an inflation device extending from a button hole behind the pocket.

Preferably, as shown in FIG. 5, a button hole 40 is provided on the end panel 20B opposite from the zipper 38. The button hole 40 may be aligned parallel to the planes of the top and bottom panels 16, 18 and is preferably centered between the top and bottom panels 16, 18. The button hole 40 is adapted to allow an inflation device, generally indicated as reference numeral 42, to be passed from the interior volume 36 of the cover 12 through the button hole 40 and outside the cover when the air cushion 14 is installed.

Figure 6:
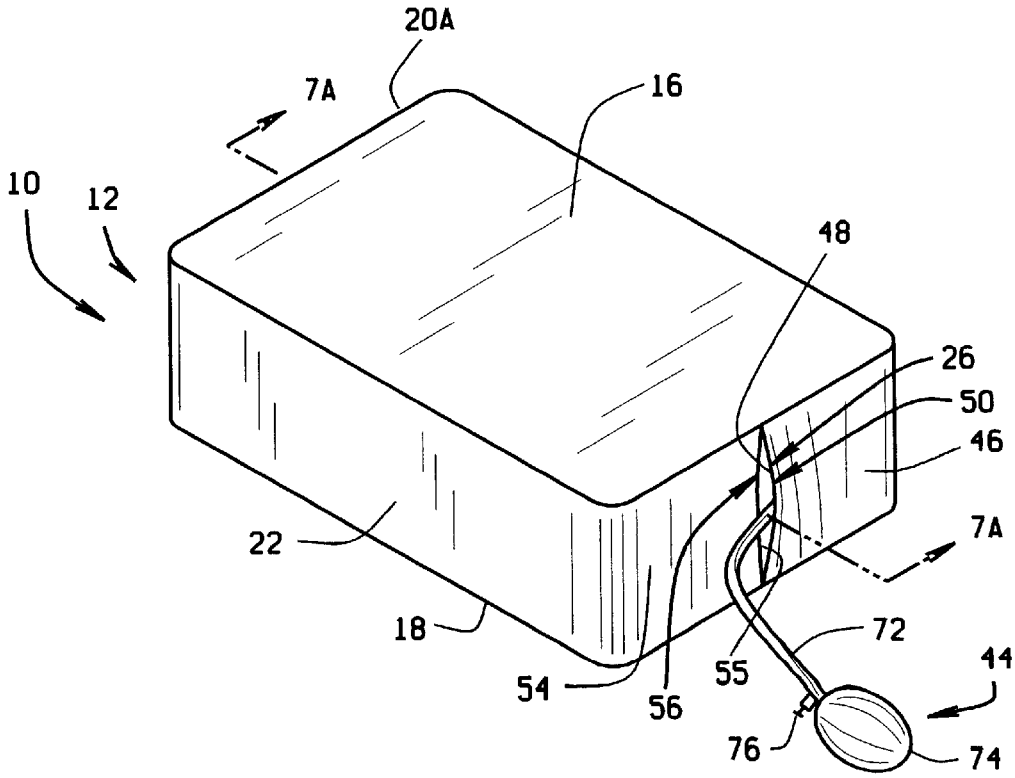
FIG. 6 is a perspective view of the pillow of FIG. 5 showing the location of the pocket or flap and the inflation device extending from a slit opening of the pocket.

Preferably, as shown in FIGS. 2 and 6, the end panel 20B is provided with a first pocket 46 to conceal the button hole. The first pocket 46 is preferably a single-ply, generally rectangular shaped piece of fabric, the same weight as the rest of the cover material. Other thickness combinations and fabric layers for the first pocket 46 may be used as described previously. Three of its four sides are attached to the end panel 20B where portions of the end panel 20B perimeter edges are attached to the portions of the edges of the top panel 16, bottom panel 18, and the adjacent side panel 22. The fourth edge 48 remains unattached, creating a first opening 50 into the pocket 46. The general rectangular shape of the pocket 46 allows it to loosely conform and lay flat against the end panel 20B. In this construction, the button hole 40 may be offset in one direction toward one end of the end panel 20B so that the inflation device 42 may be contained within the first pocket 46. The first opening 50 provides access to the button hole 40 and the interior volume 36 of the cover 12 to assist the user in the installation of the air cushion 14 in the cover 12.

As best shown in FIGS. 2 and 6, a second pocket 54 may also be attached to the same end panel 20B as the first pocket 46 to create a second opening 56 for the second pocket 54 immediately adjacent the first opening 50 of the first pocket 46. The second pocket 54 is preferably attached to the end panel 20B in a similar fashion to that of the first pocket 46, where three sides of a generally rectangular shaped piece of fabric or fabric layers are attached to portions of the perimeter edges of the end panel 20B where the end panel 20B is attached to portions of the top panel 16, bottom panel 18, and the adjacent side panel 22. The fourth edge 55 of the second pocket 54 creates the second opening 56. As seen in FIG. 2, the two free edges 48, 55 of the two pockets 46, 54 are positioned side-by-side. The combination of first 50 and second 56 openings in the pockets 46, 54 creates the vertical slit 26 that is best seen in FIG. 2. The slit 26 is preferably centered on the end panel 20B and is perpendicular to the plane of the top and bottom panels 16, 18. The second pocket 54 may serve as additional stowage space for the inflation device 42.

Figure 4:
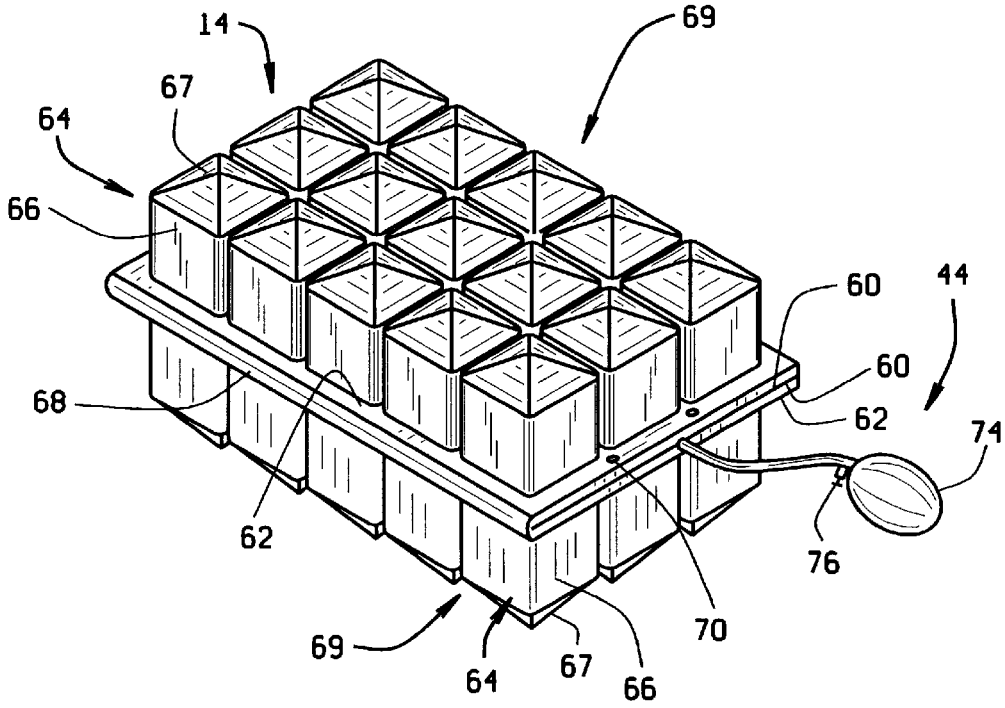
FIG. 4 is a perspective view of an air cushion of the present invention.

Preferably, the air cushion 14 of the present invention, shown in FIGS. 4 and 7, is constructed in a similar manner to that of the air mattress described in U.S. Pat. No. 5,596,781, but in a reduced size. The air cushion is generally comprised of a base sheet 60 and a top 62 sheet, each may be made from an air impervious material such as vinyl or plastic. The top sheet 62 is molded to form a plurality of air cells 64 and is affixed to the flat base sheet 60. The top sheet 62 is affixed to the base sheet 60 around the bottom edges of the air cells to form independent air cells 64, except for portions of the air cell bottom edges that are left open between the top sheet and the bottom sheet to create internal air channels (not shown) between the top sheet and bottom sheets. The internal air channels provide a path for airflow between the cells. Each cell has a generally cubical shape with four walls 66 extending outwardly from the base sheet 60. A triangular panel 67 extends from the top-most edge of each of the walls and the triangular panels come together to define a pyramidal-type shaped surface at the top of each of the independent air cells 64.

Figure 8A:
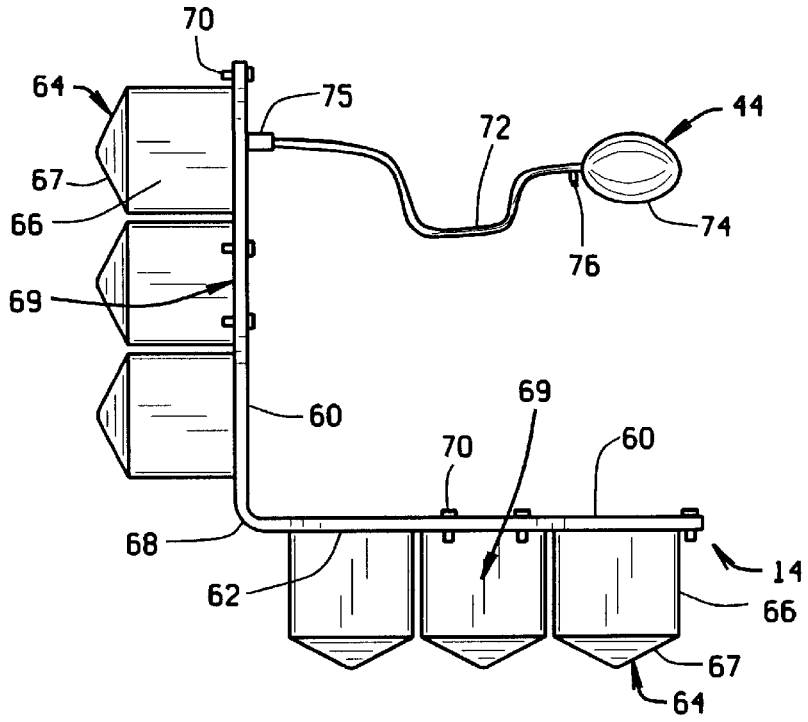
FIG. 8A is a side view of the air cushion of FIG. 4.

In the preferred embodiment shown in FIG. 8A, the air cushion 14 is folded across a fold line 68 between rows of adjacent air cells to create two side-by-side sections 69. The base sheet portions 60 of each section 69 are arranged side-by-side and the independent air cells 64 of each section 69 are arranged extending outwardly, opposite from each other. Despite the fold 68, the air cells remain interconnected by the internal air channels. In this arrangement the air cushion 14 provides the maximum amount of comfort to the user as the pillow 10 can more easily conform to the shape of the user's head, neck, and shoulders regardless of what side of the pillow is being used.

The air cushion 14 folded in the manner described above positions the air cells in a three dimensional array. In FIG. 4, an air cushion of 3×5×2 is formed by folding an air cushion 14 with an array of 6×5×1 air cells in half. The 6×5×1 array is preferred for forming a pillow of conventional size. Other array combinations may be used as required for other desired pillow sizes. For example, an air cushion array of 4×5×1 may be folded over to create an air cushion of 2×5×2 for a smaller, travel-size pillow, or an air cushion array of 4×4×1 may be folded over to create an air cushion of 2×4×2 for a juvenile size pillow. To secure the sections 69 and the base sheets 60 in the side-by-side arrangement, releasable fasteners 70, such as snaps or other types of fasteners, are provided on the perimeter of each of the base sheets 60.

Figure 8B:
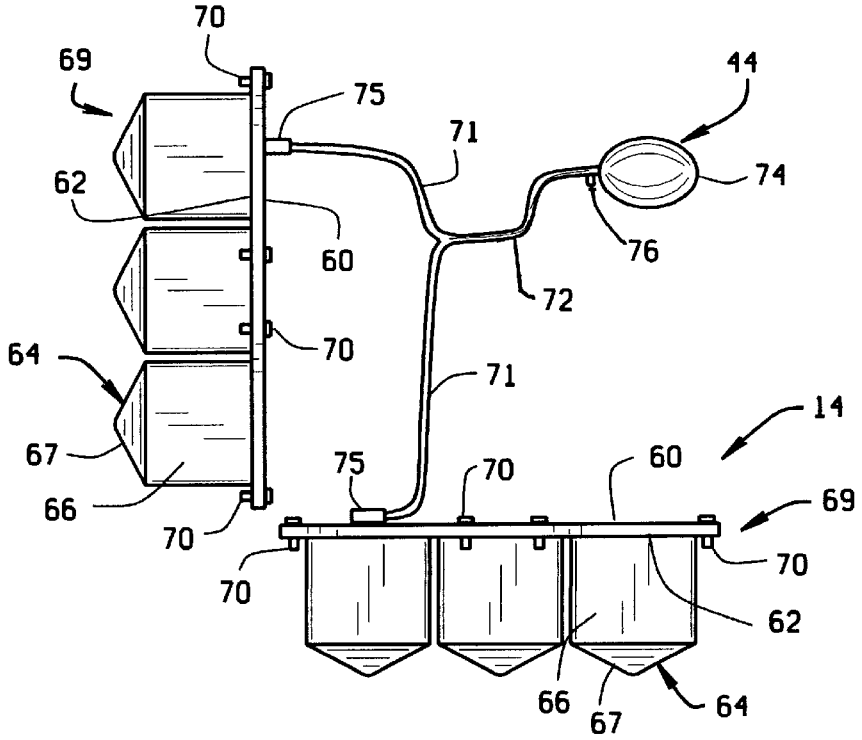
FIG. 8B is a side view of an alternate embodiment of the air cushion of FIG. 8A.

In an alternate construction of the air cushion shown in FIG. 8B, the air cushion is comprised of two independent sections 69 of air cushions interconnected via two lengths of flexible tubing 71. The flexible tubing provides air flow between each section and the internal air channels of each section. The base sheets 60 are placed in the side-by-side arrangement such that the independent air cells 64 of each section 69 extend outwardly, opposite from each other. The snaps 70 hold the sections together and the flexible tubing 71 may be placed in between the adjacent base sheets 60.

To provide air inflation to each embodiment of the air cushion, an inflation device 44 is provided. The inflation device 44 is comprised of a conduit 72 and a bulb pump 74. The conduit 72 is connected to the base sheet of the air cushion and communicates with the internal air channels and each independent air cell. In the embodiment of the air cushion 14 shown in FIG. 8A, the conduit 72 communicates directly with the base sheet 60 of the cushion. Preferably, as shown in FIGS. 7A and 7C, the conduit 72 is mounted to the base sheets by an elbow connection 75 and is positioned in between the base sheet when the base sheet is folded over into the side-by side arrangement and is held in place by the folded base sheet and the fasteners 70. FIG. 8A shows the conduit 72 mounted via the elbow 75 to the underside of the base sheet 60. In an alternate construction shown in FIG. 7B, the conduit 72 is connected to the base sheet 60 at the edge of the base sheet 60. FIG. 8B shows a configuration where the flexible tubing 71 communicates with each of the separate base sheets 60 through a pair of elbows 75 at the underside of the base sheet 60 of each section 69 and two lengths of flexible tubing 71 connected to a "Y" connector.

The inflation device 42 shown in the figures is common in the art and is comprised of the bulb pump 74 and a regulating valve 76. Although the preferred embodiment of the invention shows a manual bulb inflation device 44, other means for supplying pressure may also be used. The user inflates the air cushion 14 by squeezing the bulb pump 74. To lower air pressure or deflate the cushion 14, the user actuates a spring-loaded pressure relief valve 76 that bleeds air from the cushion 14. The inflation device 44 allows the user to control the relative resiliency of the pillow 10 by regulating the air pressure in the air cushion 14. When a manual hand held inflation device such as that shown in the Figures is used with the invention, it is preferable to provide the pockets 46, 54 on the end panel 20B of the cover 12 that store the device with the inflation device 44 readily accessible to the user. Other external means for providing inflation may make the pockets unnecessary.

To illustrate the cooperative relationship between the different aspects of the invention, the installation of the air cushion 14 into the cover 12 will be discussed. The installation is the same for the padded cover and the stretchable cover. Starting from an initial condition where the air cushion 14 is removed from the cover 12 with the air cells 64 deflated and the cushion 14 generally flat, the user accesses the interior volume 36 of the cover 12 by unzipping the access opening 24. The bulb inflation device 44 is inserted through the zippered access opening 24 of the cover 12 and through the button hole 40. Simultaneously, the user accesses the button hole 40 through the slit 26 between the pocket openings and grasps the inflation device 44 to guide it through the button hole 40 and out through the slit 26. The conduit 72 on the inflation device 44 must be long enough to allow the user to guide the inflation device 42 and bulb pump 74 through the button hole 40 and out the slit 26. Once the user pushes the inflation device 44 through the button hole 40, the user can position the air cushion 14 in the interior volume 36 of the cover 12 through the zippered access opening 24. Once the air cushion 14 is fully within the interior volume 36 of the cover 12, the access opening 24 is zipped closed and the user can begin inflation of the air cushion 14.

While the present invention has been described by reference to specific embodiments, it should be understood that modifications and variations of the invention may be constructed without departing from the scope of the invention as defined by the following claims.

What is claimed is:

1. A pillow comprising:

an inflatable cushion having first and second base sheets and first and second top sheets, the first and second base sheets are positioned side-by-side each other, the first and second top sheets are each molded in a form of a plurality of independent air cells that are secured to the respective first and second base sheets and extend outwardly in opposite directions from the first and second base sheets, the air cells are interconnected to permit air flow therebetween; and a cover over the cushion covering over the air cells of the first and second top sheets.

2. The pillow of claim 1 wherein:

the cover is constructed of an elastic material and is stretched around the air cells of the first and second top sheets.

3. The pillow of claim 1 wherein:

the cover has a top panel, a bottom panel, and four side panels extending between the top and bottom panels, the panels being secured together along perimeter edges of each panel to generally form a box shape, the cover having an access opening to receive the inflatable cushion within the cover.

4. The pillow of claim 3 wherein:

the top panel of the cushion has a first thickness and the side panels of the cushion each have a second thickness, the first thickness being greater than the second thickness.

5. The pillow of claim 4 wherein:

the bottom panel also has the first thickness.

6. The pillow of claim 5 wherein:

the first thickness of the top and bottom panels is created by a pair of batting layers, each batting layer being secured to one of each of the top and bottom panels.

7. The pillow of claim 1 wherein:

the first and second base sheets are attached together by releasable fasteners.

8. The pillow of claim 3 wherein:

the access opening has a closure mechanism that selectively opens and closes the access opening.

9. The pillow of claim 8 wherein:

the side panels are further comprised of a first and opposite second end panels, and the access opening is located in the first end panel.

10. The pillow of claim 9 wherein:

the second end panel has a button hole.

11. The pillow of claim 10 wherein:

a first pocket having a first opening is attached to the second end panel concealing the button hole.

12. The pillow of claim 11 wherein:

a second pocket having a second opening is attached to the second end panel with the second opening adjacent the first opening.

13. An air cell pillow comprising:

an inflatable cushion having a pair of flat base sheets and a pair of top sheets, each of the top sheets being molded in a form of a plurality of independent air cells and secured to its respective flat base sheet to form a section, the top sheet of one section extending outwardly from its respective base sheet in a direction opposite from the top sheet of the other section, the air cells in each section being in communication with each other through internal channels formed between the top sheet and the base sheet, each section being configured to permit air flow between the sections; and a cover over the cushion covering over the air cells of the first and second top sheets.

14. The pillow of claim 13, wherein:

the cover has a top panel, a bottom panel, and two end panels and two side panels extending between the top and bottom panels, the top panel has a first thickness and the end and side panels have a second thickness and the first thickness is greater than the second thickness.

15. The pillow of claim 14, wherein:

an access opening is provided in at least one of the end panels to allow the cushion to be inserted into and removed from the cover.

16. The pillow of claim 14, wherein:

the bottom panel also has the first thickness.

17. The pillow of claim 13, wherein:

the sections are connected by a conduit providing communication between the sections, the conduit has a extension with an inflation device is connectable to the extension to provide pressurized air into the conduit.

18. The pillow of claim 17, wherein:

an end panel of the cushion has a button hole through the end panel.

19. The pillow of claim 18, wherein:

a first pocket having a first opening is attached to the end panel over the button hole concealing the button hole.

20. The pillow of claim 19, wherein:

a second pocket having a second opening is attached to the end panel with the second opening adjacent the first opening, the extension is directed between the first and second openings into attached to a button hole and the bulb inflation device storable adjacent the end panel with the button when the cover is arranged over the inflatable cushion.

21. The pillow of claim 13, wherein:

the cover is constructed of an elastic material and is stretched around both of the sections.

22. An air cell pillow comprising:

an inflatable cushion having an upper section and lower section positioned below the upper section and connected to the upper section across a fold line, both of the upper and lower sections being formed from a single flat base sheet and a single top sheet folded across the fold line to arrange the single flat base sheet folded over itself with a portion of the base sheet of the upper section being positioned above a portion of the base sheet of the lower section, the top sheet being molded in a form of a plurality of independent air cells and secured to the base sheet except for internal channels formed between the top sheet and the base sheet, the internal channels permitting air flow between the air cells and across the fold line; and a cover over the cushion covering over the air cells of the first and second top sheets.

23. The pillow of claim 22, wherein:

the cover has a top panel, a bottom panel, and two end panels and two side panels extending between the top and bottom panels, the top panel has a first thickness and the end and side panels have a second thickness and the first thickness is greater than the second thickness.

24. The pillow of claim 23, wherein:

the bottom panel also has the first thickness.

25. The pillow of claim 22, wherein:

the inflatable cushion has a conduit in communication with the air cells and an inflation device connectable to the conduit for providing pressurized air for the conduit.

26. The pillow of claim 25, wherein:

an end panel of the cover has a button hole through the end panel and a first pocket over the button hole concealing the button hole, the conduit is directed through the button hole and attached to a bulb inflation device storable in the first pocket when the cover is arranged over the cushion.

27. The pillow of claim 22, wherein:

the cover is constructed of an elastic material and is stretched around the air cushion when the cushion is folded.

* * * * *